US010252848B2

(12) United States Patent
Murray

(10) Patent No.: US 10,252,848 B2
(45) Date of Patent: Apr. 9, 2019

(54) SELF-STANDING BARREL POUCH

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/437,675

(22) PCT Filed: Apr. 6, 2015

(86) PCT No.: PCT/US2015/024494
§ 371 (c)(1),
(2) Date: Apr. 22, 2015

(87) PCT Pub. No.: WO2015/154071
PCT Pub. Date: Oct. 8, 2015

(65) Prior Publication Data

US 2017/0008684 A1 Jan. 12, 2017

Related U.S. Application Data

(60) Provisional application No. 61/975,342, filed on Apr. 4, 2014.

(51) Int. Cl.

| | |
|---|---|
| ***B65D 5/10*** | (2006.01) |
| ***B65D 77/06*** | (2006.01) |
| ***B65D 3/04*** | (2006.01) |
| ***B65D 3/30*** | (2006.01) |
| ***B65D 85/72*** | (2006.01) |

(52) U.S. Cl.
CPC ..... *B65D 77/067* (2013.01); *B65D 3/04* (2013.01); *B65D 3/30* (2013.01); *B65D 77/06* (2013.01); *B65D 85/72* (2013.01)

(58) Field of Classification Search
CPC ..... B65D 77/067; B65D 3/04; B65D 3/30; B65D 85/72; B65D 75/008; B65D 2575/583; B65D 2207/00
USPC ..... 229/117.3; 383/104, 10, 906, 120, 126, 383/907
See application file for complete search history.

(56) References Cited

U.S. PATENT DOCUMENTS 3,128,019 A 4/1964 Mills
5,843,540 A * 12/1998 Heydarpour ..... B32B 27/32 383/10
2004/0091182 A1 5/2004 Versluys
(Continued)

FOREIGN PATENT DOCUMENTS

EP 1241112 A2 9/2002

OTHER PUBLICATIONS

International Search Report and Written Opinion for PCT/US2015/024494, dated Jul. 16, 2015.

*Primary Examiner* — Christopher R Demeree
(74) *Attorney, Agent, or Firm* — Dinsmore & Shohl LLP

(57) ABSTRACT

A flexible pouch having a pair of spaced apart flaps is provided. The flexible pouch includes a pouch body having a generally cylindrical shape. The flaps are disposed along the longitudinal length of the pouch body as to help prevent the pouch body from rolling over when laid on its length. The pouch may further include a fitment and an intermediate portion having a ramp shaped portion. The ramp shaped portion is opposite the fitment and slanted so as to direct fluids towards the fitment.

9 Claims, 6 Drawing Sheets

(56) References Cited

U.S. PATENT DOCUMENTS

| | | | | |
|---|---|---|---|---|
| 2006/0108375 | A1* | 5/2006 | Pritchard | B65D 33/2508 222/107 |
| 2009/0238495 | A1 | 9/2009 | Anderson | |
| 2011/0094495 | A1 | 4/2011 | Lamensdorf | |
| 2011/0210143 | A1* | 9/2011 | Jones | B65D 75/008 222/1 |
| 2016/0297590 | A1* | 10/2016 | You | B65D 75/525 |

* cited by examiner

SELF-STANDING BARREL POUCH

CROSS-REFERENCE TO RELATED APPLICATIONS

This application is the U.S. national stage of PCT/US2015/024494 filed Apr. 6, 2015, which claims priority of U.S. Provisional Patent Application Ser. No. 61/975,342 filed on Apr. 4, 2014, which is incorporated herein by reference.

FIELD OF THE INVENTION

The present invention relates generally to a flexible pouch. Specifically, a flexible pouch having flaps configured to stabilize and support the flexible pouch is provided.

BACKGROUND OF THE INVENTION

Flexible pouches are currently known and used. Flexible pouches may conveniently store products such as beverages, consumable goods or personal items. Further, flexible pouches are portable and may be easily used with one hand. Flexible pouches may include gussets disposed along the sides to help the pouch expand and hold more. Some currently known flexible pouches are self-standing, meaning the pouches are configured to hold themselves in a generally upright manner.

Flexible pouches in the shape of barrel are also known. Such pouches have an elongated cylindrical body, and may include a tap. Currently such pouches are made such that the elongated body is aligned along a horizontal axis, and the tap is disposed along a bottom edge of the pouch to allow gravity to dispense fluids held within the pouch body. However, it should be appreciated that such a pouch is easy to knock over since it is standing with its length extending vertically. Placing such a pouch along its length will prevent the barrel pouch from being knocked over. However, when placed on its length, the tubular dimension of such a pouch may cause the pouch to roll.

Accordingly, it remains desirable to have a cylindrical pouch configured to remain stable when supported by its length. It is further desirable to have a flexible pouch having an inner surface configured to direct liquid contents towards the tap.

SUMMARY OF THE INVENTION

A flexible pouch is provided. The pouch includes a pouch body. The pouch body may be formed from a sheet(s) of laminate material. The pouch body has a pair of gusseted ends, also formed of laminate material. A top seal closes the top portion of the pouch. A pair of flaps are disposed on opposite sides of the pouch body. The flaps extend longitudinally between the gusseted ends, and also project outwardly from the pouch body so as prevent the pouch body from rolling.

The pouch may include a handle. The handle may be formed of the same laminate material as the flexible pouch. In one embodiment, the pouch is disposed along a top edge of the pouch body. In another embodiment, the handles are disposed adjacent one of the gusseted ends.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE INVENTION

A flexible pouch is provided. The pouch includes a pouch body. The pouch body may be formed from a sheet(s) of laminate material. The pouch body has a pair of gusseted ends, also formed of laminate material. A top seal extends between a top portion of the gusseted end. A pair of flaps are disposed on opposite sides of the pouch body. The flaps extend longitudinally between the gusseted ends, and also project outwardly from the pouch body so as prevent the pouch body from rolling.

Figure 1:
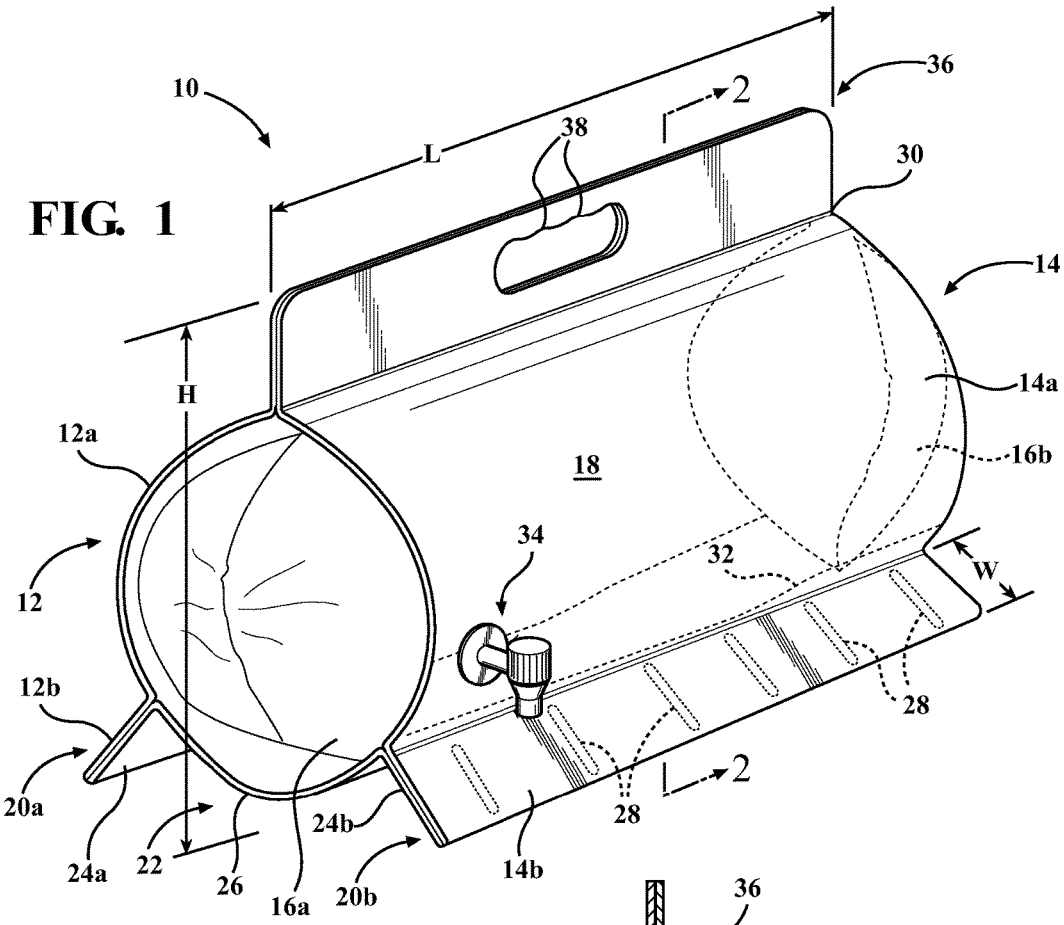
FIG. 1 is a perspective view of the flexible pouch supported by a pair of flaps.

With reference now to FIG. 1, a view of the components of a flexible pouch 10 is provided. The flexible pouch 10 includes a first side and a second sheets 12, 14 and a pair of ends 16*a*, 16*b* spaced apart from each other so as to define a pouch body 18. The ends 16*a*, 16*b* are gussets. The first and second sheets 12, 14 define respective first and second side surfaces 12*a*, 14*a* which are spaced apart from each other. The pair of end gussets 16*a*, 16*b* are mounted to respective ends 16*a*, 16*b* of the pouch body 18. The end gussets 16*a*, 16*b* are configured to expand the pouch 10. The end gussets 16*a*, 16*b* are disposed between the first and second side surfaces 12, 14 of the flexible pouch 10 and are opposite of each other with respect to the longitudinal length of the pouch 10. The longitudinal length of the pouch body 18 is greater than its height and width so as to form a generally cylindrical shape.

The pouch 10 further includes a pair of flaps 20*a*, 20*b* spaced apart from each other. The flaps 20*a*, 20*b* are disposed on respective first and second side surfaces 12, 14 of the flexible pouch 10. The flaps 20*a*, 20*b* may be formed by a bottom panel 22. The bottom panel 22 may be formed of the same material as the pouch body 18.

The bottom panel 22 includes a pair of opposing side portions 24*a*, 24*b* and an intermediate portion 26. The side portions 24*a*, 24*b* and intermediate portion 26 run the longitudinal length of the bottom panel 22. The side portions 24*a*, 24*b* are sealed to respective the longitudinal side ends 12*b*, 14*b* of the first and second sheets 12, 14 so as to form respective flaps 20*a*, 20*b* with the intermediate portion 26 of the bottom panel 22 disposed therebetween. The flaps 20*a*, 20*b* are formed along the bottom edge of the pouch 10 and extends outwardly from the bottom intermediate portion 26 of the bottom panel 22. The flaps 20*a*, 20*b* have a width defined by the letter "W" sufficient to provide stability when the pouch 10 is seated on the intermediate portion 26 of the bottom panel 22. The width may be generally one quarter the length of the height of the pouch as defined by the reference letter "H." The flaps 20*a*, 20*b* may be thermally treated so as to provide structural rigidity to either prevent the pouch 10 from rolling or to suspend the pouch body 18 above the ground or table on which the pouch 10 rests.

For instance, the flaps 20*a*, 20*b* may include strips of material 28 spaced apart from each other and extending along an axis orthogonal to the longitudinal length of the bottom panel 22. The strips of material 28 may be sealed between the side portions 24*a*, 24*b* and the respective first and second sheets so as to provide sufficient rigidity to the flaps 20*a*, 20 to support the pouch body in suspension.

Figure 2:
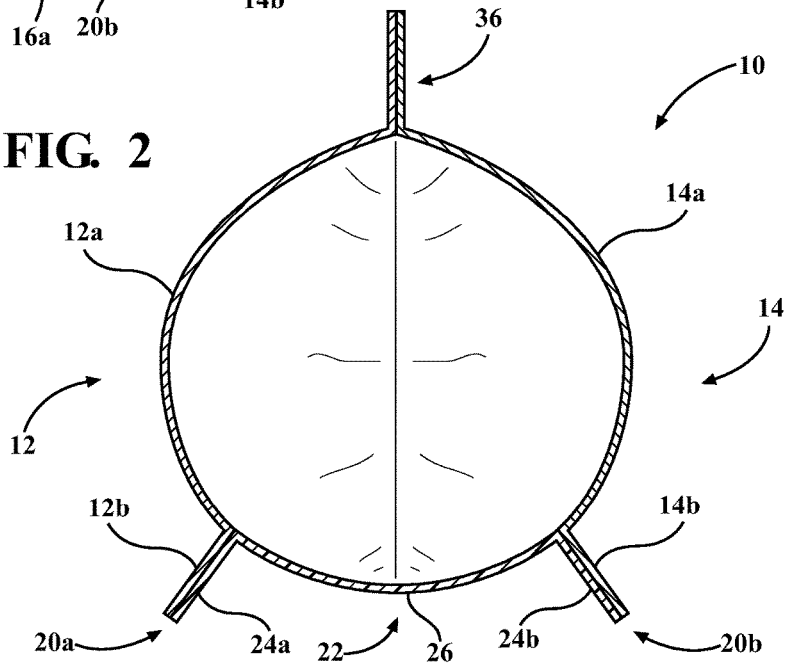
FIG. 2 is cross sectional view of FIG. 1 taken along lines 2-2.

With reference now to FIG. 2, a cross sectional view of the pouch 10 shown in FIG. 1 is provided. FIG. 2 shows the side portions 24*a* of the bottom panel 22 sealed to respective side edges of the first and second sheets 12, 14 so as to form flaps 20*a*, 20*b*. FIG. 2 also shows the intermediate portion 26 of the bottom panel 22 disposed between the flaps 20*a*, 20*b*.

The top of the first and second sheets 12, 14 are sealed together so as to form a top sealed edge 30. The top seal edge 30 is formed at the top of the pouch 10 and extends along the length of the pouch 10, between the end gussets 16*a*, 16*b* so as to close the top of the pouch 10.

With reference again to FIG. 1, the bottom panel 22 may be angled so as to direct fluids from one end of the pouch body 18 to the other. In such an embodiment, one end of the bottom panel 22 is sealed to the respective first and second sheets 14, 16 at a higher point relative to the other end of the bottom panel 22. Thus, the bottom panel 22 may include a ramp shaped portion 32. For illustrative purposes, the ramp shaped portion 32 may extend upwardly along the H direction from one end of the pouch 10 and gradually slant downward to the other end along the L direction.

A fitment 34 may be mounted to an end of pouch 10. The fitment 34 is configured to provide access to the contents of the pouch 10. Preferably the fitment 34 is a tap which may be mounted towards a bottom portion of an end gusset 16*a* opposite the ramp shaped portion 32 of the bottom panel 22. Alternatively, the fitment 34 may be mounted on one of either the first or second side surfaces 12*a*, 14*a* of the pouch 10. Thus, the ramp shaped portion 32 is configured to help direct fluids to the fitment 34.

The pouch 10 may further include a handle 36. The handle 36 may be formed from excess material disposed above the top sealed edge 30. With reference again to FIG. 1, the handle 36 is an oblong opening having undulations on a top surface configured to accommodate the grip of a user. The handle 36 is shown having a plurality undulations for which a user may grip. It should be appreciated that the handle 36 may be formed in different dimensions without narrowing the scope of the invention. The handle 36 and the flaps 20*a*, 20*b* may be equidistant away from each other.

Figure 3:
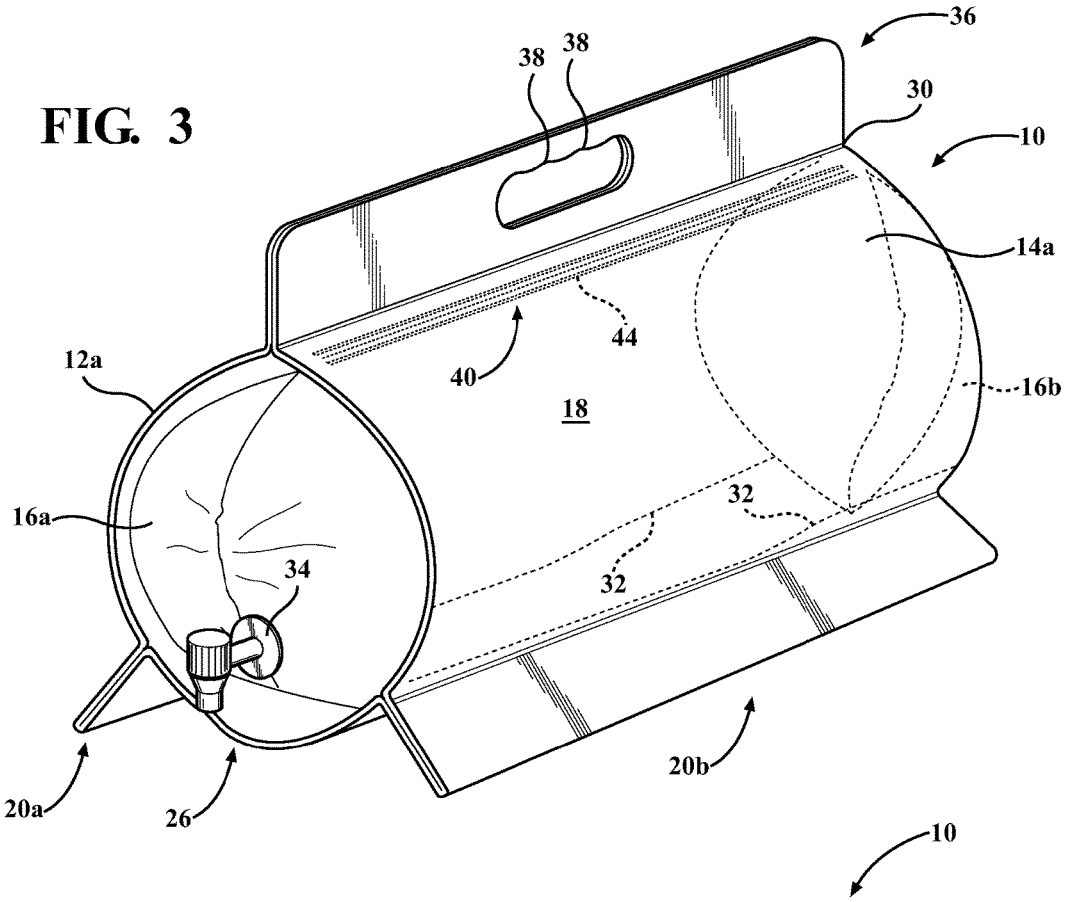
FIG. 3 is a perspective view of another illustrative embodiment of the pouch formed by a single sheet of material.

With reference now to FIG. 3, an illustrative example of the pouch 10 is provided wherein the pouch 10 is formed of a single sheet of material folded onto itself wherein the single sheet forms the first and second side surfaces 12*a*, 14*a* of the pouch body 18. The ends of the pouch are sealed together so as to form the handle 36. The opening of the handle 36 may be trimmed out. The flaps 20*a*, 20*b* are formed by sealing portions of the sheet of material onto itself. The flaps 20*a*, 20*b* may be sealed so as to form the ramp shaped portion 32. The open ends of the sheet are closed by sealing the pair of end gussets 16*a*, 16*b* thereto.

Figure 4:
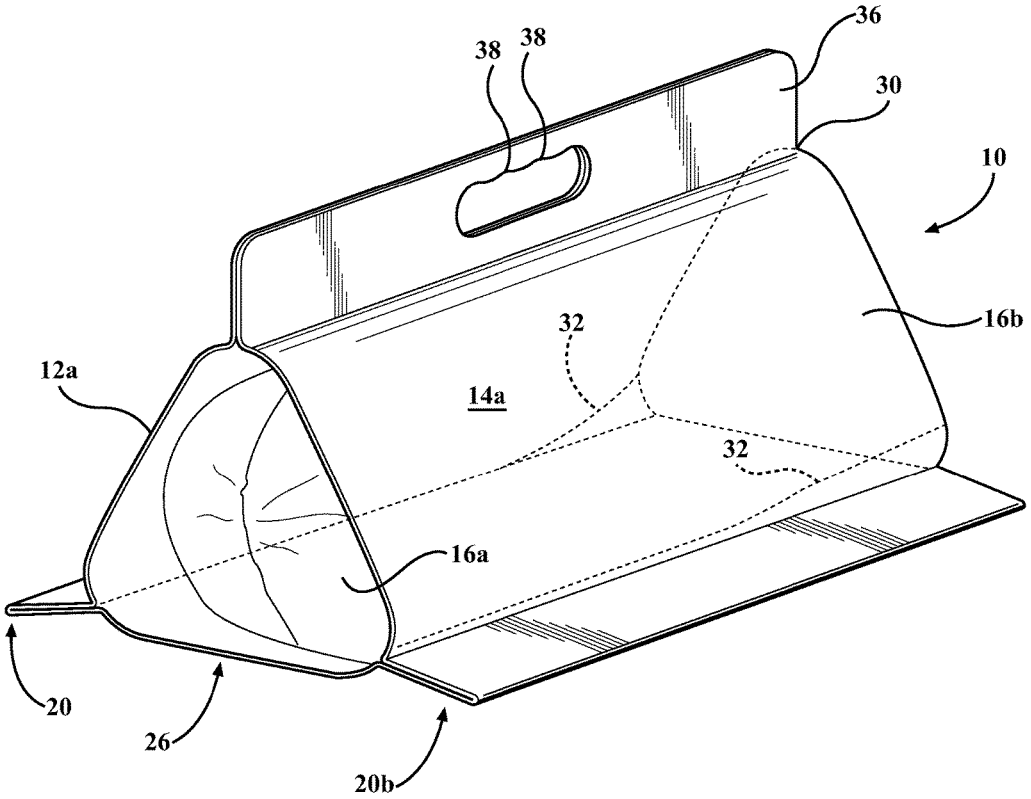
FIG. 4 is a perspective view of another illustrative embodiment of the pouch body showing a zipper.

With reference now to FIG. 4, another illustrative example of the pouch 10 is provided wherein the shape of the pouch 10 is dimensioned so as to have a generally planar bottom with the first and second side surfaces 12*a*, 14*a* angled towards each other. Thus, it should be appreciated that the dimension and shape of the pouch body is provided for illustrative purposes and should not be read in a limiting manner. As described above, the pouch 10 is formed by a single sheet of material.

Figure 5:
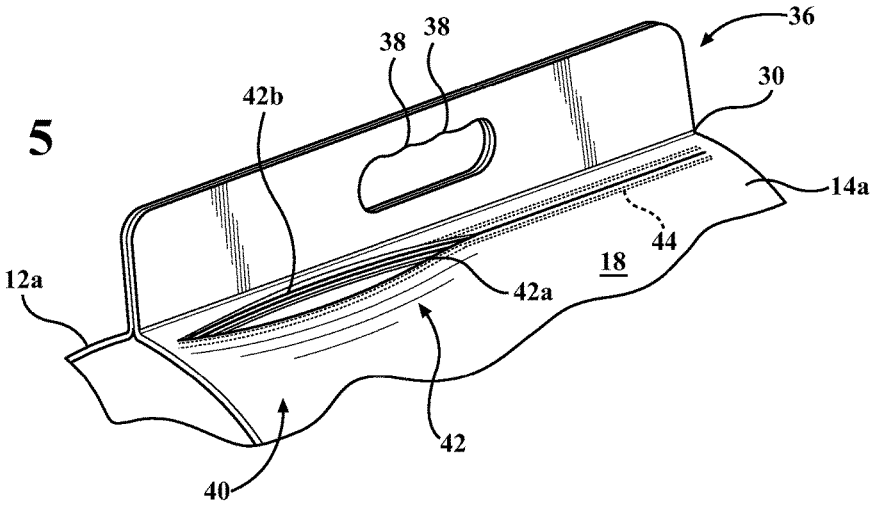
FIG. 5 is a perspective view of another illustrative embodiment of the pouch body shaped like a purse.

With reference now to FIGS. 3 and 5, the pouch may include a reclosable top 40. The reclosable top 40 may be formed beneath handle 36 and extend between the top portion of the end gussets 16*a*, 16*b*. The reclosable top 40 may include a closing assembly 42 having a male member 42*a* and a female member 42*b* disposed on opposite inner surfaces of the first and second side surfaces 12*a*, 14*a* of the pouch 10. The closing assembly 42 is configured to open and close the closable top 34 so as to allow users to access the contents within the pouch body 18 and close the pouch body 18 when finished.

The male member 42*a* may be a rib extending outwardly from the inner surface of the first side surface 12*a*, and the female member 42*b* may be a channel disposed along the inner surface of the first side surface 12*a* opposite the male member 42*a*. However, it should be appreciated that the location of the closing assembly 42 is provided for illustrative purposes only. For instance the closing assembly 42 may be disposed on the second side surface 14*a*.

The male member 42*a* and the female member 42*b* are positioned to engage each other so as to close the top portion of the pouch 10. It should be appreciated that other closing assemblies may be adapted for use herein, illustratively including a zipper. Preferable, the closing assembly 42 is covered with a seal 44 (indicated by dashed lines) in FIG. 5. The seal 44 provides a tamper proof function of the pouch 10 so as to allow consumers notice that the pouch 10 has been accessed or tampered with. The seal 44 may be peeled off to provide access to the closing assembly 42.

Figure 6:
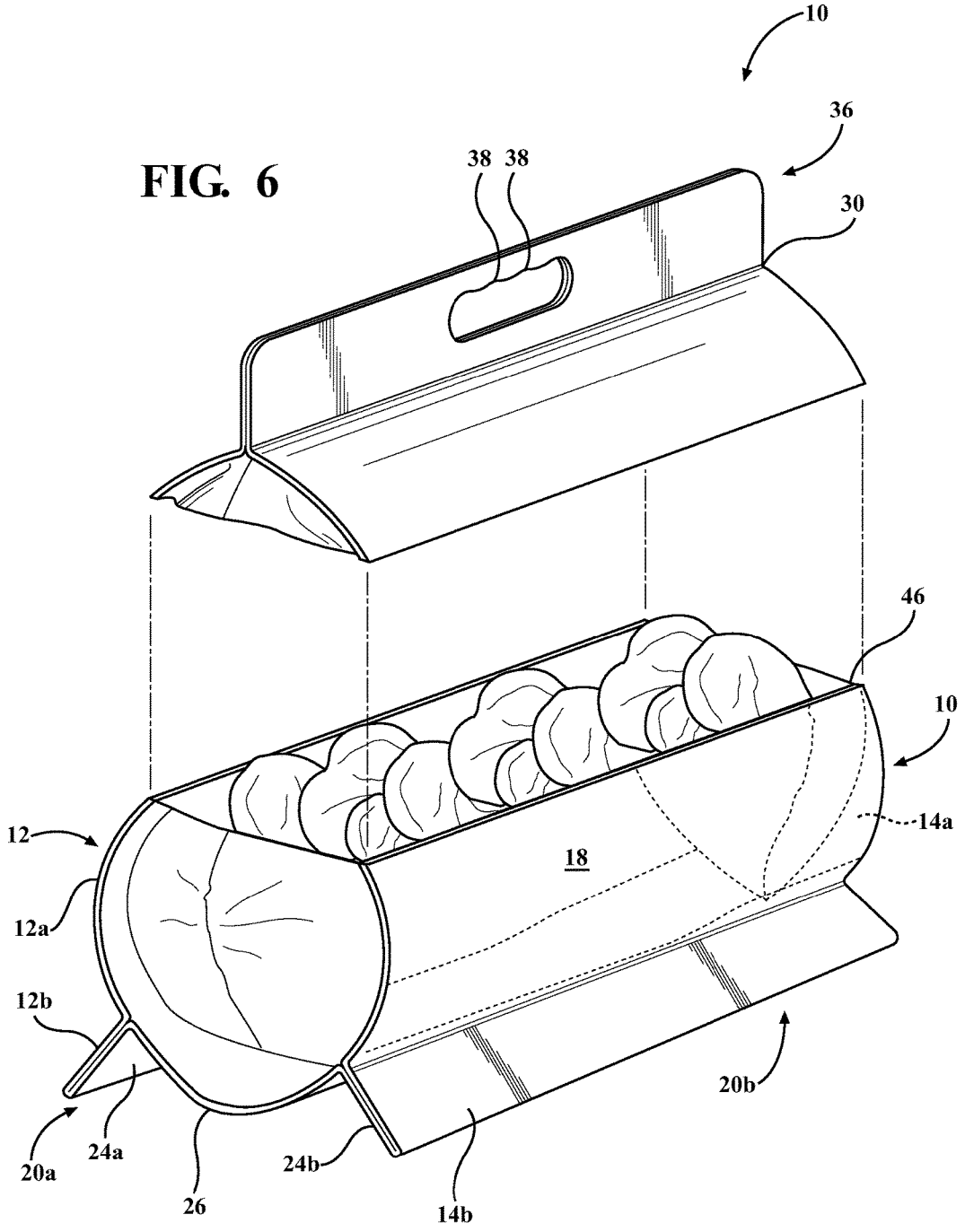
FIG. 6 is a perspective view of another illustrative embodiment of the pouch body showing the handle detached.

With reference now to FIG. 6, the pouch 10 may include a parting line 46. The parting line 46 extends generally axially between the top portion of the end gussets 16*a*, 16*b*. The parting line 46 is configured to allow the handle 36 to separate from the pouch body 18 so as to form a top opening 40. Thus, in instances wherein the pouch 10 contains items such as potato chips, the parting line 46 is useful in allowing maximum access to the chips. The parting line 46 may be formed by including a thinned out section of a respective first and second side surfaces 12*a*, 14*a* so as to make the parting line weaker in structural strength, relative to the remainder of the pouch 10. The parting line 46 may be disposed between the closing assembly 42 and the handle 36.

Figure 7:
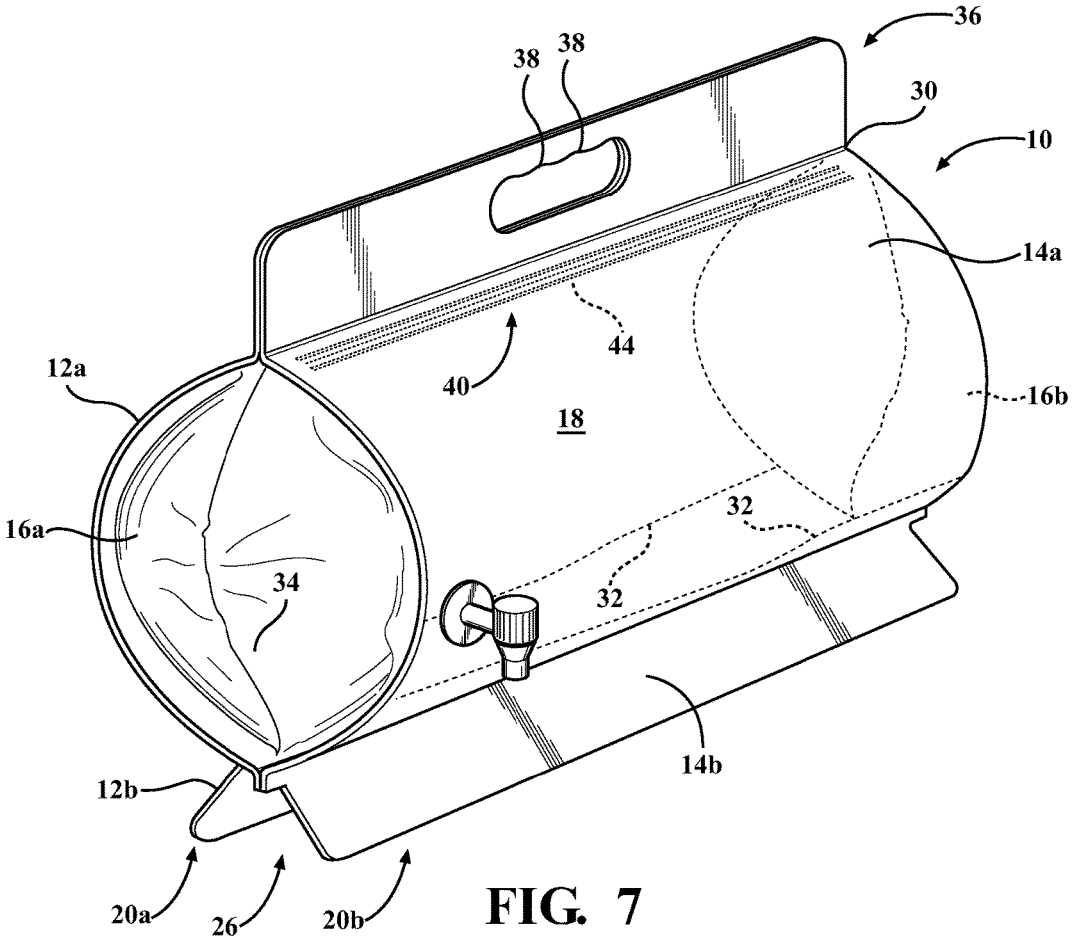
FIG. 7 is a perspective view another illustrative embodiment of the flaps.
Figure 8:
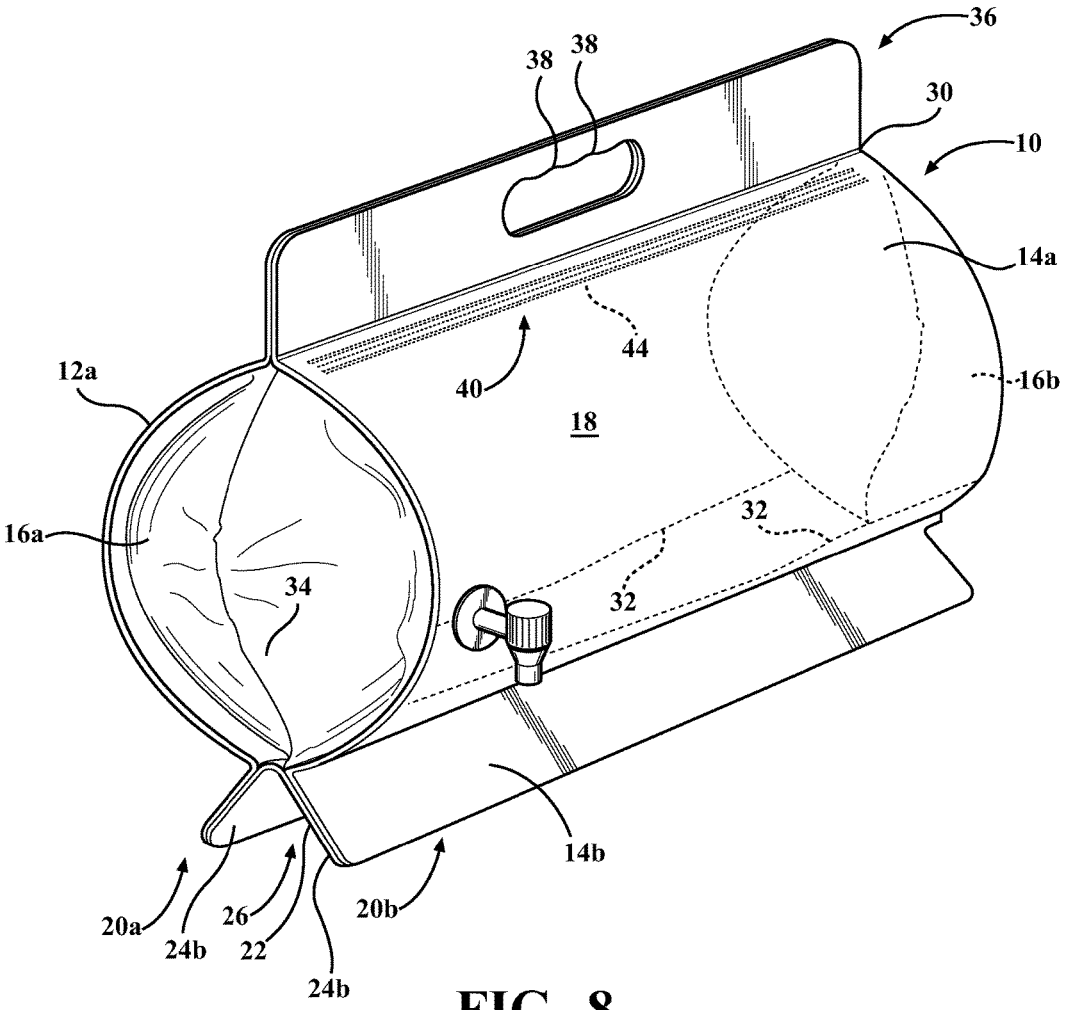
FIG. 8, is a perspective view of another illustrative embodiment of the flaps.

With reference now to FIGS. 7 and 8, illustrative examples of the flaps 20 is provided. The flaps 20 are configured to support the pouch 10 above a surface. FIG. 7 shows a pouch 10 formed of two sheets of material 12, 14. The distal ends of the sheets 12, 14 are cut so as to form flaps 20*a*, 20*b*. The intermediate portion 26 is a planar seal extending the axial length of the pouch body 18. The sheets 12, 14 are sealed together to form the intermediate portion 26, and the flaps 20*a*, 20*b* extend outwardly from the intermediate portion 26.

FIG. 8 shows an embodiment of the flaps 20 wherein the flaps 20*a*, 20*b* are angled with respect to each other so as to form a "V". The flaps 20*a*, 20*b* are formed by the distal ends of the sheets 12*b*, 14*b* and the bottom panel 22. The intermediate portion 26 is generally the bent portion of the bottom panel 22 separating the side portions 24*a*, 24*b*. The side portions 24*a*, 24*b* are sealed to the distal end 12*b*, 14*b* of respective sheets 12, 14.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

The invention claimed is:

1. A flexible pouch having a first side surface spaced apart from a second side surface, and a first end including a gusset spaced apart from a second end including a gusset so as to define a pouch body, the pouch body having a cylindrical shape, the flexible pouch comprising:

a pair of flaps spaced apart from each other and disposed on respective first and second side surfaces of the pouch body, each of the pair of flaps extending along a length of the side surfaces between the first end and second end of the pouch body;

a fitment mounted to the flexible pouch;

an intermediate portion disposed between the pair of flaps, the intermediate portion includes a ramp shaped portion, the ramp shaped portion extending along a length of the intermediate portion and defined by an end of the intermediate portion sealed to the first and second side panels at a greater height at the first end relative to the second end, the first end opposite the fitment, the ramp shaped portion is slanted so as to direct a fluid towards the fitment.

2. The flexible pouch as set forth in claim 1, further including a handle, the handle disposed along a top portion of the pouch body.

3. The flexible pouch as set forth in claim 2, wherein the handle includes an opening with a plurality of undulations so as to facilitate the grip of a user.

4. The flexible pouch as set forth in claim 3, wherein the handle and the pair of flaps are equidistant from each other.

5. The flexible pouch as set forth in claim 4, further including a reclosable top, the reclosable top disposed beneath the handle and between the first and second ends of the pouch body.

6. The flexible pouch as set forth in claim 5, wherein the reclosable top includes a closing assembly configured to open and close the reclosable top.

7. The flexible pouch as set forth in claim 6, wherein the closing assembly includes a female member and a male member configured to engage the female member, the male and female member disposed opposite each other on a respective inner surface of one of the side surfaces of the pouch.

8. The flexible pouch as set forth in claim 2, further including a parting line, the parting line configured to allow the handle to separate from the pouch body so as to form a top opening.

9. The flexible pouch as set forth in claim 8, wherein the parting line is a thinned out section of the pouch body.

* * * * *